US006745846B1

(12) United States Patent
Innes et al.

(10) Patent No.: US 6,745,846 B1
(45) Date of Patent: Jun. 8, 2004

(54) EXPANDABLE DOWNHOLE TUBING

(75) Inventors: Gareth Innes, Aberdeen (GB); Peter Oosterling, Berkel en Roderijs (NL)

(73) Assignee: E2 Tech Limited, Houston, TX (US)

( * ) Notice: Subject to any disclaimer, the term of this patent is extended or adjusted under 35 U.S.C. 154(b) by 0 days.

(21) Appl. No.: 10/070,004

(22) PCT Filed: Sep. 6, 2000

(86) PCT No.: PCT/GB00/03403

§ 371 (c)(1),
(2), (4) Date: Jul. 8, 2002

(87) PCT Pub. No.: WO01/18353

PCT Pub. Date: Mar. 15, 2001

(30) Foreign Application Priority Data

Sep. 6, 1999 (GB) ..... 9920934
Oct. 23, 1999 (GB) ..... 9925017

(51) Int. Cl.[7] ..... E21B 33/12
(52) U.S. Cl. ..... 166/387; 166/115
(58) Field of Search ..... 166/380–382, 166/387, 115, 113, 242.1

(56) References Cited

U.S. PATENT DOCUMENTS

| | | | | |
|---|---|---|---|---|
| 3,203,451 | A | | 8/1965 | Vincent |
| 3,504,515 | A | | 4/1970 | Reardon |
| 3,722,588 | A | * | 3/1973 | Tamplen |
| 3,860,270 | A | * | 1/1975 | Arnold |
| 4,109,716 | A | * | 8/1978 | Canalizo |
| 4,178,992 | A | * | 12/1979 | Regan et al. |
| RE30,690 | E | * | 7/1981 | Cnalizo |
| 5,494,106 | A | | 2/1996 | Gueguen et al. ..... 166/277 |
| 6,085,838 | A | | 7/2000 | Vercaemer et al. ..... 166/277 |
| 6,098,717 | A | | 8/2000 | Bailey et al. ..... 166/382 |
| 6,135,208 | A | | 10/2000 | Gano et al. ..... 166/313 |
| 6,527,049 | B2 | | 3/2003 | Metcalfe et al. ..... 166/277 |
| 3,776,307 | A1 | | 12/2003 | Young ..... 166/125 |
| 2002/0166668 | A1 | | 11/2002 | Metcalfe et al. ..... 166/378 |

FOREIGN PATENT DOCUMENTS

| | | |
|---|---|---|
| CA | 2006931 | 10/1995 |
| EP | 0961007 | 1/1999 |
| WO | WO 9721901 | 6/1997 |
| WO | WO 9822690 | 5/1998 |
| WO | WO 9842947 | 10/1998 |

* cited by examiner

*Primary Examiner*—Roger Schoeppel
(74) *Attorney, Agent, or Firm*—Moser, Patterson & Sheridan, L.L.P.

(57) ABSTRACT

The present invention relates to portions of casing that are inserted into a wellbore. The casing portions are provided with a protected portion in which a friction and/or sealing material can be located. In certain embodiments, the protected portion is provided by first and second annular shoulders that are spaced-apart axially along the length of the casing. The friction and/or sealing material is typically located on an outer surface of the casing between the annular shoulders. There is also provided a casing portion that has annular shoulders provided at either end of the casing portion, with means to connect successive casing portions located on these shoulders. The casing portion in this embodiment is provided with a friction and/or sealing material in a recessed portion of the casing portion.

18 Claims, 6 Drawing Sheets

EXPANDABLE DOWNHOLE TUBING

CROSS REFERENCE TO RELATED APPLICATIONS

This application is the U.S. national phase application of PCT International Application No. PCT/GB00/03403, filed Sep. 6, 2000.

FIELD OF THE INVENTION

The present invention relates to apparatus and methods and particularly, but not exclusively, to an expander device and method for expanding an internal diameter of a casing, pipeline, conduit or the like. The present invention also relates to a tubular member such as a casing, pipeline, conduit or the like.

BACKGROUND OF THE INVENTION

A borehole is conventionally drilled during the recovery of hydrocarbons from a well, the borehole typically being lined with a casing. Casings are installed to prevent the formation around the borehole from collapsing. In addition, casings prevent unwanted fluids from the surrounding formation from flowing into the borehole, and similarly, prevent fluids from within the borehole escaping into the surrounding formation.

Boreholes are conventionally drilled and cased in a cascaded manner; that is, casing of the borehole begins at the top of the well with a relatively large outer diameter casing. Subsequent casing of a smaller diameter is passed through the inner diameter of the casing above, and thus the outer diameter of the subsequent casing is limited by the inner diameter of the preceding casing. Thus, the casings are cascaded with the diameters of the successive casings reducing as the depth of the well increases. This successive reduction in diameter results in a casing with a relatively small inside diameter near the bottom of the well that could limit the amount of hydrocarbons that can be recovered. In addition, the relatively large diameter borehole at the top of the well involves increased costs due to the large drill bits required, heavy equipment for handling the larger casing, and increased volumes of drill fluid which are required.

Each casing is typically cemented into place by filling an annulus created between the casing and the surrounding formation with cement. A thin slurry cement is pumped down into the casing followed by a rubber plug on top of the cement. Thereafter, drilling fluid is pumped down the casing above the cement that is pushed out of the bottom of the casing and into the annulus. Pumping of drilling fluid is stopped when the plug reaches the bottom of the casing and the wellbore must be left, typically for several hours, whilst the cement dries. This operation requires an increase in drill time due to the cement pumping and hardening process, which can substantially increase production costs.

To overcome the associated problems of cementing casings and the gradual reduction in diameters thereof, it is known to use a more pliable casing that can be radially expanded so that an outer surface of the casing contacts the formation around the borehole. The pliable casing undergoes plastic deformation when expanded, typically by passing an expander device, such as a ceramic or steel cone or the like, through the casing. The expander device is propelled along the casing in a similar manner to a pipeline pig and may be pushed (using fluid pressure for example) or pulled (using drill pipe, rods, coiled tubing, a wireline or the like).

Additionally, a rubber material or other high friction coating is often applied to selected portions of the outer surface of the unexpanded casing to increase the grip of the expanded casing on the formation surrounding the borehole or previously installed casing. However, when the casing is being run-in, the rubber material on the outer surface is often abraded during the process, particularly if the borehole is highly deviated, thereby destroying the desired objective.

SUMMARY OF THE INVENTION

According to a first aspect of the present invention there is provided a tubular member for a wellbore, the tubular member including coupling means to facilitate coupling of the tubular member into a string, the coupling means being disposed on an annular shoulder provided at at least one end of the tubular member, the tubular member further including at least one recess wherein a friction and/or sealing material is located within the recess.

Typically, the tubular member is a casing, pipeline, conduit or the like. The tubular member may be of any length, including a pup joint.

The at least one recess is preferably an annular recess.

The at least one recess is typically weakened to facilitate plastic deformation of the at least one recess. Heat is typically used to weaken the at least one recess.

The internal diameter of the at least one recess is typically reduced with respect to the internal diameter of the tubular member adjacent the recess. The internal diameter of the at least one recess is typically reduced by a multiple of a wall thickness of the tubular member. The internal diameter of the at least one recess is preferably reduced by an amount between 0.5 and 5 times the wall thickness, and most preferably by an amount between 0.5 and 2 times the wall thickness. Values outside of these ranges may also be used.

Preferably, the coupling means is disposed on an annular shoulder provided at each end of the tubular member. The coupling means typically comprises a threaded coupling. A first screw thread is typically provided on the annular shoulder at a first end of the tubular member, and a second screw thread is typically provided on the annular shoulder at a second end of the tubular member. The coupling means typically comprises a pin connection on one end and a box connection on the other end. Thus, a casing string or the like can be created by threadedly coupling successive lengths of tubular member.

The inner diameter of the annular shoulder is typically enlarged with respect to the inner diameter of the tubular member adjacent the annular shoulder. The inner diameter of the annular shoulder is typically increased by a multiple of a wall thickness of the tubular member. The inner diameter of the annular shoulder is preferably enlarged by an amount between 0.5 and 5 times the wall thickness, and most preferably enlarged by an amount between 0.5 and 2 times the wall thickness. Values outside of these ranges may also be used.

The tubular member is preferably manufactured from a ductile material. Thus, the tubular member is capable of sustaining plastic deformation.

According to a second aspect of the present invention there is provided an expander device comprising a body provided with a first annular shoulder, and a second annular shoulder spaced apart from the first annular shoulder.

The expander device is typically used to expand the diameter of a tubular member such as a casing, pipeline, conduit or the like.

The radial expansion of the second annular shoulder is preferably greater than the radial expansion of the first annular shoulder.

The expander device is preferably used to expand a tubular member, the tubular member including coupling means to facilitate coupling of the tubular member into a string, the coupling means being disposed on an annular shoulder provided at at least one end of the tubular member, the tubular member further including at least one recess wherein a friction and/or sealing material is located within the recess.

The second annular shoulder is preferably spaced apart from the first annular shoulder by a distance substantially equal to the distance between an annular shoulder of a preceding tubular member (when coupled together into a string) and the at least one recess of the tubular member. Preferably, the first annular shoulder of the expander device contacts the at least one recess of the tubular member substantially simultaneously with the second annular shoulder of the expander device entering an annular shoulder of the tubular member. The force required to expand the annular shoulder of the tubular member is significantly less than the force required to expand the nominal inner diameter portions of the tubular member. Thus, as the second annular shoulder of the expander device enters the annular shoulder of the tubular member, the force required to expand the nominal inner diameter portions of the tubular member is not required to expand the annular shoulders of the tubular member and the difference in force facilitates an increase in the force which is required to expand the diameter of the at least one recess.

The expander device is typically manufactured from steel. Alternatively, the expander device may be manufactured from ceramic, or a combination of steel and ceramic. The expander device is optionally flexible.

The expander device is optionally provided with at least one seal. The seal typically comprises at least one O-ring.

The expander device is typically propelled through the tubular member, pipeline, conduit or the like using fluid pressure. Alternatively, the device may be pigged along the tubular member or the like using a conventional pig or tractor. The device may also be propelled using a weight (from the string for example), or may be pulled through the tubular member or the like (using drill pipe, rods, coiled tubing, a wireline or the like).

According to a third aspect of the present invention, there is provided a method of lining a borehole in an underground formation, the method comprising the steps of lowering a tubular member into the borehole, the tubular member including coupling means to facilitate coupling of the tubular member into a string, the coupling means being disposed on an annular shoulder provided at at least one end of the tubular member, the tubular member further including at least one recess wherein a friction and/or sealing material is located within the recess, and applying a radial force to the tubular member using an expander device to induce a radial deformation of the tubular member and/or the underground formation.

The expander device preferably comprises a body provided with a first annular shoulder, and a second annular shoulder spaced apart from the first annular shoulder.

The method typically includes the further step of removing the radial force from the tubular member.

The tubular member is preferably manufactured from a ductile material. Thus, the tubular member is capable of sustaining plastic deformation.

The at least one recess is preferably an annular recess.

The at least one recess is typically weakened to facilitate plastic deformation of the at least one recess. Heat is typically used to weaken the at least one recess.

The friction and/or sealing material is typically located within the at least one recess when the tubular member is unexpanded. The friction and/or sealing material typically becomes proud of the outer surface adjacent the at least one recess of the tubular member when the at least one recess is expanded by the first annular shoulder on the expander device. The friction and/or sealing material typically becomes proud of the outer surface of the tubular member when the at least one recess is expanded by the second annular shoulder on the expander device.

The internal diameter of the at least one recess is typically reduced with respect to the internal diameter of the tubular member adjacent the recess. The internal diameter of the at least one recess is typically reduced by a multiple of a wall thickness of the tubular member. The internal diameter of the at least one recess is preferably reduced by an amount between 0.5 and 5 times the wall thickness, and most preferably reduced by an amount between 0.5 and 2 times the wall thickness. Values outside of these ranges may also be used.

Preferably, the coupling means is disposed on an annular shoulder provided at at least one end of the tubular member. The coupling means typically comprises a threaded coupling. A first screw thread is typically provided on the annular shoulder at a first end of the tubular member, and a second screw thread is typically provided on the annular shoulder at a second end of the tubular member. The coupling means typically comprises a pin connection on one end and a box connection on the other end. Thus, a tubular member string can be created by threadedly coupling successive lengths of tubular member.

The inner diameter of the annular shoulder is typically enlarged with respect to the inner diameter of the tubular member adjacent the annular shoulder. The inner diameter of the annular shoulder is typically increased by a multiple of a wall thickness of the tubular member. The inner diameter of the annular shoulder is preferably enlarged by an amount between 0.5 and 5 times the wall thickness, and most preferably enlarged by an amount between 0.5 and 2 times the wall thickness. Values outside of these ranges may also be used.

The tubular member is preferably manufactured from a ductile material. Thus, the tubular member is capable of sustaining plastic deformation.

The expander device is typically used to expand the diameter of the tubular member, pipeline, conduit or the like.

The radial expansion of the second annular shoulder is preferably greater than the radial expansion of the first annular shoulder.

The expander device is preferably used to expand a tubular member, the tubular member including coupling means to facilitate coupling of the tubular member into a string, the coupling means being disposed on an annular shoulder provided at at least one end of the tubular member, the tubular member further including at least one recess wherein a friction and/or sealing material is located within the recess.

The second annular shoulder is preferably spaced apart from the first annular shoulder by a distance substantially equal to the distance between the annular shoulder and the at least one recess of the tubular member. Preferably, the first annular shoulder of the expander device contacts the at least one recess of the tubular member substantially simultaneously with the second annular shoulder of the expander device entering an annular shoulder of the tubular member. The force required to expand the annular shoulder of the tubular member is significantly less than the force required to expand the nominal inner diameter portions of the tubular member. Thus, as the second annular shoulder of the expander device enters the annular shoulder of the tubular member, the force required to expand the nominal inner diameter portions of the tubular member is not required to expand the annular shoulders of the tubular member and the difference in force facilitates an increase in the force which is required to expand the diameter of the at least one recess.

The expander device is typically manufactured from steel. Alternatively, the expander device may be manufactured from ceramic, or a combination of steel and ceramic. The expander device is optionally flexible.

The expander device is optionally provided with at least one seal. The seal typically comprises at least one O-ring.

The expander device is typically propelled through the tubular member, pipeline, tubular or the like using fluid pressure. Alternatively, the device may be pigged along the tubular member or the like using a conventional pig or tractor. The device may also be propelled using a weight (from the string for example), or may be pulled through the tubular member or the like (using drill pipe, rods, coiled tubing, a wireline or the like).

According to a fourth aspect of the present invention there is provided a tubular member for a wellbore, the tubular member including a friction and/or sealing material applied to an outer surface of the tubular member, the friction and/or sealing material being disposed on a protected portion so that the friction and/or sealing material is substantially protected whilst the tubular member is being run into the wellbore.

Typically, the tubular member is a casing, pipeline, conduit or the like. The tubular member may be of any length, including a pup joint.

The protected portion typically comprises a valley located between two shoulders. The valley is typically of the same inner diameter as the tubular member. The shoulders typically have an inner diameter that is typically increased by a multiple of a wall thickness of the tubular member. The inner diameter of the shoulder is preferably enlarged by an amount between 0.5 and 5 times the wall thickness, and most preferably enlarged by an amount between 0.5 and 2 times the wall thickness. Values outside of these ranges may also be used. The shoulders typically comprise annular shoulders. The valley typically comprises an annular valley.

Alternatively, the protected portion may comprise a cylindrical portion located substantially adjacent a shoulder portion, wherein the outer diameter of the shoulder portion is preferably of a greater diameter than the outer diameter of the cylindrical portion. The shoulder is preferably located so that the cylindrical portion is substantially protected whilst the tubular member is being run into the wellbore. Thus, the friction and/or sealing material is substantially protected by the shoulder whilst the member is being run into the wellbore. The cylindrical portion is typically of the same inner diameter as the tubular member. The shoulder typically has an inner diameter that is typically increased by a multiple of a wall thickness of the tubular member. The inner diameter of the shoulder is preferably enlarged by an amount between 0.5 and 5 times the wall thickness, and most preferably enlarged by an amount between 0.5 and 2 times the wall thickness. Values outside of these ranges may also be used.

The protected portion may alternatively comprise a recess in the outer diameter of the tubular member. The recess may be machined, for example, or may be swaged. The friction and/or sealing material is typically located within said recess. In these embodiments, the outer diameter of the tubular member remains substantially the same over the length of the member, as the friction and/or sealing material is located within the recess.

Typically, the tubular member includes coupling means to facilitate coupling of the tubular member into a string. Alternatively, the lengths of tubular member may be welded together or coupled in any other conventional manner.

The coupling means is typically disposed at each end of the tubular member. The coupling means typically comprises a threaded coupling. The coupling means typically comprises a pin on one end of the tubular member, and a box on the other end of the tubular member. Thus, a casing string or the like can be created by threadedly coupling successive lengths of tubular member.

The tubular member is preferably manufactured from a ductile material. Thus, the tubular member is capable of sustaining plastic deformation.

BRIEF DESCRIPTION OF THE DRAWINGS

Embodiments of the present invention shall now be described, by way of example only, with reference to the accompanying drawings, in which.

DETAILED DESCRIPTION OF THE INVENTION

Figure 1:
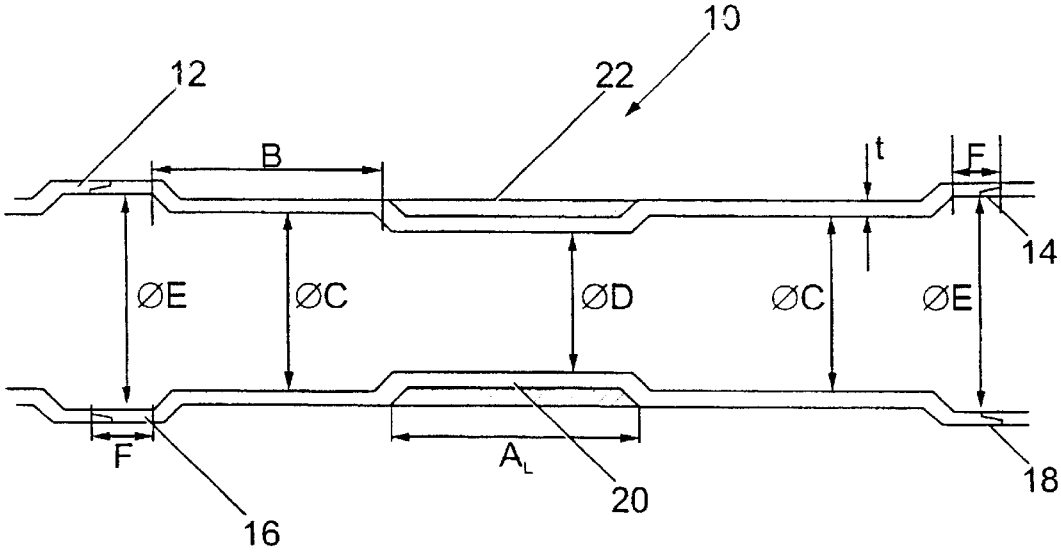
FIG. 1 is a cross-portion of a portion of casing in accordance with a first aspect of the present invention.
Figure 2:
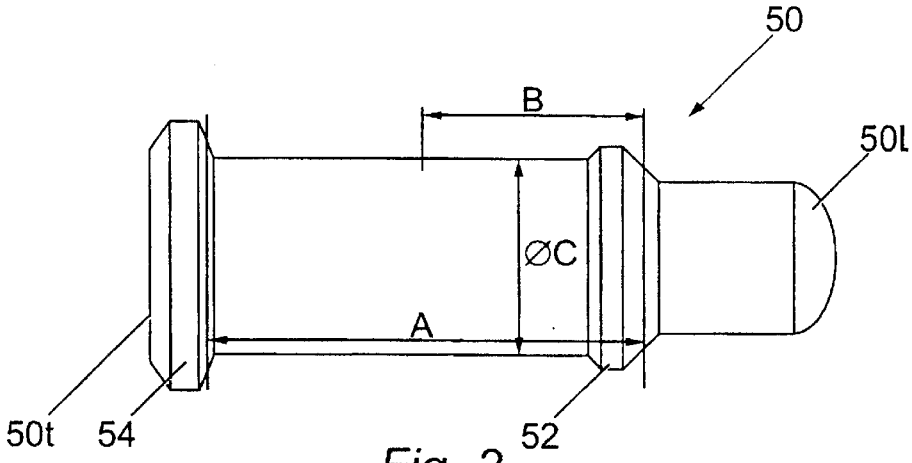
FIG. 2 is an elevation of an expander device in accordance with a second aspect of the present invention.
Figure 3:
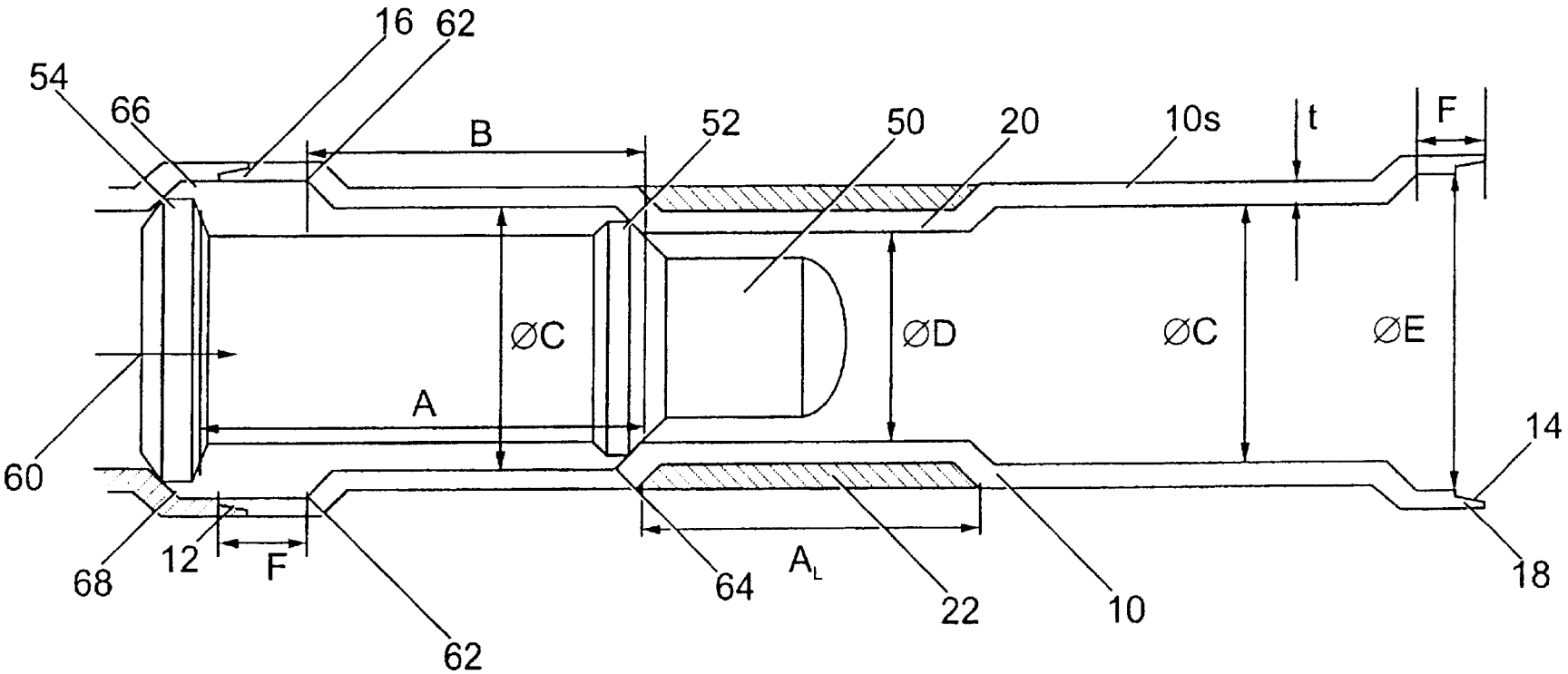
FIG. 3 illustrates the expander device of FIG. 2 located in the casing portion of FIG. 1.

It should be noted that FIGS. 1 to 3 are not drawn to scale, and more particularly, the relative dimensions of the expander device of FIGS. 2 and 3 are not to scale with the relative dimensions of a casing portion 10 of FIGS. 1 and 3. It should also be noted that the casing portions 10, 100 described herein may be of any length, including pup joints.

The term "valley" as used herein is to be understood as being any portion of casing portion having a first diameter that is adjacent one or more portions having a second diameter, the second diameter generally being greater than the first diameter. The term "recess" as used herein is to be understood as being any portion of casing having a reduced diameter that is less than a nominal diameter of the casing.

Referring to the drawings, FIG. 1 shows a casing portion 10 in accordance with a first aspect of the present invention.

Casing portion 10 is preferably manufactured from a ductile material and is thus capable of sustaining plastic deformation.

Casing portion 10 is provided with coupling means 12 located at a first end of the casing portion 10, and coupling means 14 located at a second end of the casing portion 10. The coupling means 12, 14 are typically threaded connections that allow a plurality of casing portions 10 to be coupled together to form a string (not shown). Threaded coupling 12 is typically of the same hand to that of threaded coupling 14 wherein the coupling 14 can be mated with a coupling 12 of a successive casing portion 10. It should be noted that any conventional means for coupling successive lengths of casing portion may be used, for example welding.

Expandable casing strings are typically constructed from a plurality of threadedly coupled casing portions. However, when the casing is expanded, the threaded couplings are typically deformed and thus generally become less effective, often resulting in loss of connection, particularly if the casings are expanded by more than, say, 20% of their nominal diameter.

However, in casing portion 10, the coupling means 12, 14 are provided on respective annular shoulders 16, 18. The shoulders 16, 18 are typically of a larger inner diameter E than a nominal inner diameter C of the casing portion 10. Diameter E is typically equal to the nominal inner diameter C plus a multiple y times the wall thickness t; that is, E=C+yt. The multiple y can be any value and is preferably between 0.5 and 5, most preferably between 0.5 and 2, although values out with these ranges may also be used.

Thus, when the casing portion 10 is expanded (as will be described), the diameter E of the shoulders 16, 18 is required to be expanded by a substantially smaller amount than that of the nominal inner diameter C. It should be noted that the inner diameter E of the annular shoulders 16, 18 may not require to be expanded. For example, the nominal diameter C may be expanded by, say, 25% which in a conventional expandable casing where the threaded couplings are not provided on annular shoulders of increased inner diameter may result in a loss of connection between successive lengths of casing. However, as the threaded couplings 12, 14 are provided on respective annular shoulders 16, 18, then the shoulders are expanded by a smaller amount (if at all), for example around 10%, which significantly reduces the detrimental effect of the expansion on the coupling and substantially reduces the risk of the connection being lost.

The outer surface of conventional casing portions is sometimes coated with a friction and/or sealing material such as rubber. Thus, when the casing is run into the wellbore and expanded, the friction and/or sealing material contacts the formation surrounding the borehole, thus enhancing the contact between the casing and the formation, and optionally providing a seal in the annulus between the casing and the formation.

However, as the lengths of casing are being run into the well, the friction and/or sealing material is often abraded during the process, particularly in boreholes that are highly deviated, thus destroying the desired objective.

Casing portion 10 is also provided with at least one recess 20 that has an axial length $A_L$, and in which a rubber compound 22 or other friction and/or sealing increasing material may be positioned. The recess 20 in this embodiment is an annular recess, although this is not essential. The inner diameter D of the recess 20 is typically reduced by some multiple x times the wall thickness t; that is, D=C−xt. The multiple x can have any value, but is preferably between 0.5 and 5, most preferably between 0.5 and 2, although values outwith these ranges may also be used.

The recess 20 is typically weakened using, for example, heat treatment. When expanded, the recess 20 becomes stronger and the heat treatment results in the recess 20 being more easily expanded.

When the recess 20 is expanded, the friction and/or sealing material 20 becomes proud of an outer surface 10*s* of the casing portion 10 and thus contacts the formation surrounding the wellbore. However, as the friction and/or sealing material 22 is substantially within the recess 20 before expansion of the casing portion 10, then the material 22 is substantially protected as the casing portion 10 is being run into the wellbore thus substantially reducing the possibility of the material 20 becoming abraded.

In this particular embodiment, the friction and/or sealing material 22 is located within the recess 20, and typically comprises any suitable type of rubber or other resilient material. For example, the rubber may be of any suitable hardness (e.g. between 40 and 90 durometers or more). In this embodiment, the material 22 simply fills the recess 20, but the material 22 may be configured and/or profiled, such as those shown in FIGS. 6 and 7 described below.

Thus, there is provided a casing portion that can be radially expanded with reduced risk of loss of connection at the threaded couplings due to the provision of the couplings on annular shoulders. Additionally, the recess prevents the friction and/or sealing material from becoming abraded when the casing is run into a wellbore.

Referring now to FIG. 2, there is shown an expander device 50 for use when expanding the casing portion 10. The expander device 50 is provided with a first annular shoulder 52 at or near a first end thereof, typically at a leading end 50*l*. The largest diameter of the first annular shoulder 52 is dimensioned to be approximately the same as, or slightly less than, the nominal diameter C of the casing portion 10.

Spaced apart from the first annular shoulder 52 is a second annular shoulder 54, typically provided at or near a second end of the expander device 50, for example at a trailing end 50*t*. The diameter of the second annular shoulder 54 is typically dimensioned to be the final expanded diameter of the casing portion 10.

The expander device 50 is typically manufactured of a ceramic material. Alternatively, the device 50 may be of steel, or a combination of steel and ceramic. The device 50 is optionally flexible so that it can flex when being propelled through a casing string or the like (not shown) whereby it can negotiate any variations in the internal diameter of the casing or the like.

Referring now to FIG. 3, there is shown the expander device 50 within the casing portion 10 in use. The expander device 50 is propelled along the casing string using, for example, fluid pressure in the direction of arrow 60. The device 50 may also be pigged in the direction of arrow 60 using a pig or tractor for example, or may be pulled in the direction of arrow 60 using drill pipe, rods, coiled tubing, a wireline or the like, or may be pushed using fluid pressure, weight from a string or the like.

As the device 50 is propelled along the casing string, the internal diameter of the string (and thus the external diameter) is radially expanded. The plastic radial deformation of the string causes the outer surface 10*s* of the casing portion 10 to contact the formation surrounding the borehole (not shown), the formation typically also being radially deformed. Thus, the casing string is expanded wherein the outer surface 10*s* contacts the formation and the casing string is held in place due to this physical contact without having to use cement to fill an annulus created between the outer surface 10*s* and the formation. Thus, the increased production cost associated with the cementing process, and the time taken to perform the cementing process, are substantially mitigated.

The casing portion 10 is typically capable of sustaining a plastic deformation of at least 10% of the nominal inner diameter C. This allows the casing portion 10 to be expanded sufficiently to contact the formation whilst preventing the casing portion 10 from rupturing.

The force required to expand the diameter of the casing portion 10 by, say, 20% can be considerable. In particular, when the expander device 50 is propelled along the casing portion 10, the first annular shoulder 52 is used to expand the annular recess 20 to a diameter substantially equal to that of the nominal diameter C of the casing portion 10. Additionally, the second annular shoulder 54 is required to expand the nominal diameter C of the casing portion 10 whereby the outer surface 10*s* contacts the surrounding formation.

It is apparent that the force required to simultaneously expand the recess 20 and the nominal diameter C is considerable. Thus, dimension A (which is the longitudinal distance between the first and second annular shoulders 52, 54) is advantageously designed to be slightly greater than a dimension B. Dimension B is the longitudinal distance between a point 62 where the diameter E of the annular shoulder 16 begins to reduce down to the nominal diameter C, and a point 64 where the nominal diameter C begins to reduce down to the diameter D of the annular recess 20.

The reductions or increments in diameter between diameters C, D and E of casing portion 10 are typically radiused to facilitate the expansion process.

The distance between the point 62 and the end 66 of the casing portion is defined as dimension F taking into account an overlap that results from the threaded coupling of consecutive casing portions 10. It then follows that dimension A is substantially equal to dimension B plus two times F, taking into account the overlap.

Figure 4:
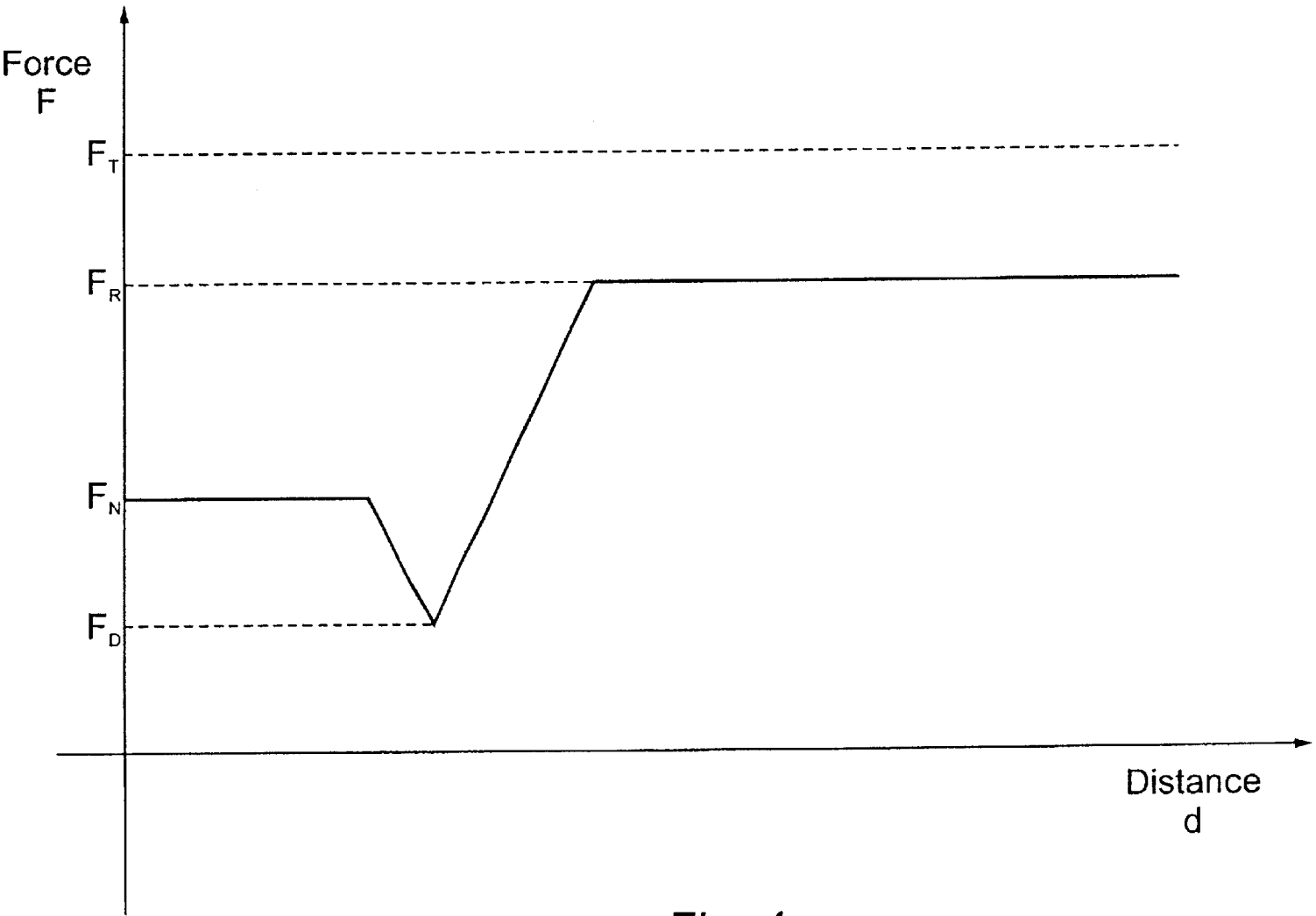
FIG. 4 is a graph of force F against distance d that exemplifies the change in force required to expand portions of the casing of FIGS. 1 and 3.

Referring to FIG. 4, there is shown a graph of force F against distance d that exemplifies the change in force required to expand the diameters C, D and E.

Force F*N* is the nominal force required to expand portions of the casing portion 10 with nominal diameter C. Force $F_D$ is the reduced force that is required to expand the portions of the casing portion 10 with diameter E. Force $F_R$ is the increased force that is required to expand the recess 20 whilst simultaneously expanding portions of the casing 10 with diameter E (that is forces $F_N$+$F_D$).

As the expander device 50 is propelled along the casing string the force $F_N$ is generated to expand the casing string. When the expander device 50 reaches a point 68 (FIG. 3) where the second annular shoulder 54 of the expander device 50 enters the annular shoulder 16 of the casing portion 10, then the force reduces as the annular shoulder 16 requires to be expanded by a relatively smaller amount. This is shown in FIG. 4 as a gradual decrease in force to $F_D$, which is the force required to expand the portions of the casing string having diameter E (i.e. the annular shoulders 16, 18). As the expander device 50 continues to be propelled in the direction of arrow 60, then the first annular shoulder 52 of the expander device 50 contacts the recess 20 at point 64 (FIG. 3). As can be seen in FIG. 4, a total force $F_T$ that would be required to expand the portions of casing 10 having a nominal diameter C and the recess 20 where annular shoulders 16, 18 are not used is substantially greater than both the nominal force $F_N$ and the decreased force $F_D$. However, with the reduction in force to the decreased force $F_D$ resulting from the position of the annular shoulders 16, 18 on the casing portion 10, and the relative spacing of the first and second annular shoulders 52, 54 on the expander device 50, the force $F_R$ required to expand the recess 20 and the annular shoulders 16, 18 is substantially less than the total force $F_T$ that would have been required to expand a casing without the annular shoulders 16, 18.

Thus, when dimension A is substantially equal to, or slightly less than, dimension B plus two times F, the first annular shoulder 52 contacts the recess 20 when the second annular shoulder 54 enters the portion of the casing portion 10 with diameter E, thereby allowing the larger force required to expand the recess 20 and the annular shoulders 16, 18 to be made available.

It should be noted that expansion of the recess 20 is a two-stage process. Firstly, the first annular shoulder 52 expands diameter D to be substantially equal to diameter C (i.e. the nominal diameter). Thereafter, the second annular shoulder 54 expands the portions of the casing string having diameter C to be substantially equal to diameter E (or greater if required).

Figure 5:
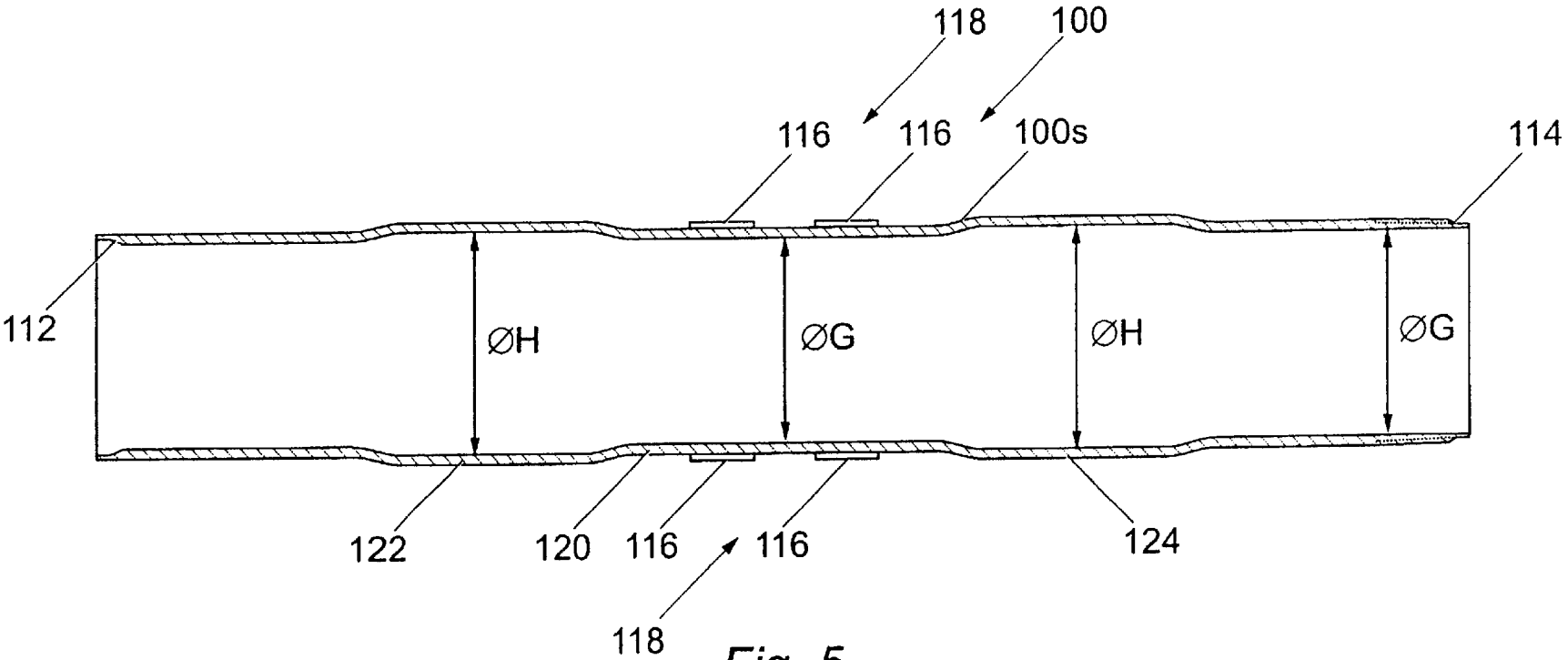
FIG. 5 is a cross-portion of a portion of casing in accordance with a fourth aspect of the present invention.

Referring now to FIG. 5 there is shown a casing portion 100 in accordance with a fourth aspect of the present invention. Casing portion 100 is preferably manufactured from a ductile material and is thus capable of sustaining plastic deformation. Casing portion 100 may be any length, including a pup joint.

Casing portion 100 is provided with coupling means 112 located at a first end of the casing portion 100, and coupling means 114 located at a second end of the casing portion 100. Coupling means 112 typically comprises a box connection and coupling means 114 typically comprises a pin connection, as is known in the art. The pin and box connections allow a plurality of casings 100 to be coupled together to form a string (not shown). It should be noted that any conventional means for coupling successive lengths of casing portion may be used, for example welding.

Casing portion 100 includes a friction and/or sealing material 116 applied to an outer surface 100*s* of the casing portion 100 in a protected portion 118. The protected portion 118 typically comprises a valley 120 located between two shoulders 122, 124. It should be noted that casing portion 100 may be provided with only one shoulder 122, 124, where the shoulder 122, 124 is arranged in use to be vertically lower downhole than the friction and/or sealing material 116 so that the material 116 is protected by shoulder 122, 124 whilst the casing portion 100 is being run into the wellbore. In other words, the one shoulder 122, 124 precedes and thus protects the material 116 as the casing portion 100 is being run into the hole.

The shoulders 122, 124 are typically of a larger inner diameter H than a nominal inner diameter G of the casing portion 100. Diameter H is typically equal to the nominal inner diameter G plus a multiple z times the wall thickness t; that is, H=G+zt. The multiple z can be any value and is preferably between 0.5 and 5, most preferably between 0.5 and 2, although values out with these ranges may also be used.

The at least one shoulder(s) 122, 124 are preferably formed by expanding the casing portion 100 with a suitable expander device (not shown) at the surface; i.e. prior to introduction of the casing portion 100 into the borehole. The friction and/or sealing material 116 may be applied to the protected portion 118 of the outer surface 100*s* after the shoulders 122, 124 have been formed, although the material 116 may be applied to the outer surface 100*s* prior to the forming of the shoulders 122, 124.

The protected portion 118 may alternatively comprise a recess (not shown) that is machined in the outer diameter of the casing portion 100. In this embodiment, the friction and/or sealing material 116 is located within the recess so that it is substantially protected whilst the casing portion 100 is run into the wellbore. A further alternative would be to locate the friction and/or sealing material 116 on a swaged portion (i.e. a crushed portion), thus forming a protected portion of the casing portion 100. These particular embodiments do not require any shoulders to be provided on the casing portion 100.

It should be noted that the protected portion 118 may take any suitable form; that is it may not for example be strictly coaxial with and parallel to the rest of the casing portion 100.

As shown in FIG. 5, the friction and/or sealing material 116 may comprise two or more bands of the material 116. The material 116 in this example comprises two typically annular bands of rubber, each band being 0.15 inches (approximately 3.81 mm) thick, by five inches (approximately 127 mm) long. The rubber can be of any particular hardness, for example between 40 and 90 durometers, although other rubbers or resilient materials of a different hardness may be used.

It should be noted however, that the configuration of the friction and/or sealing material 116 may take any suitable form. For example, the material 116 may extend along the length of the valley 118. It should also be noted that the material 116 need not be annular bands; the material 116 may be disposed in any suitable configuration.

Figures 6A, 6B, 6C:
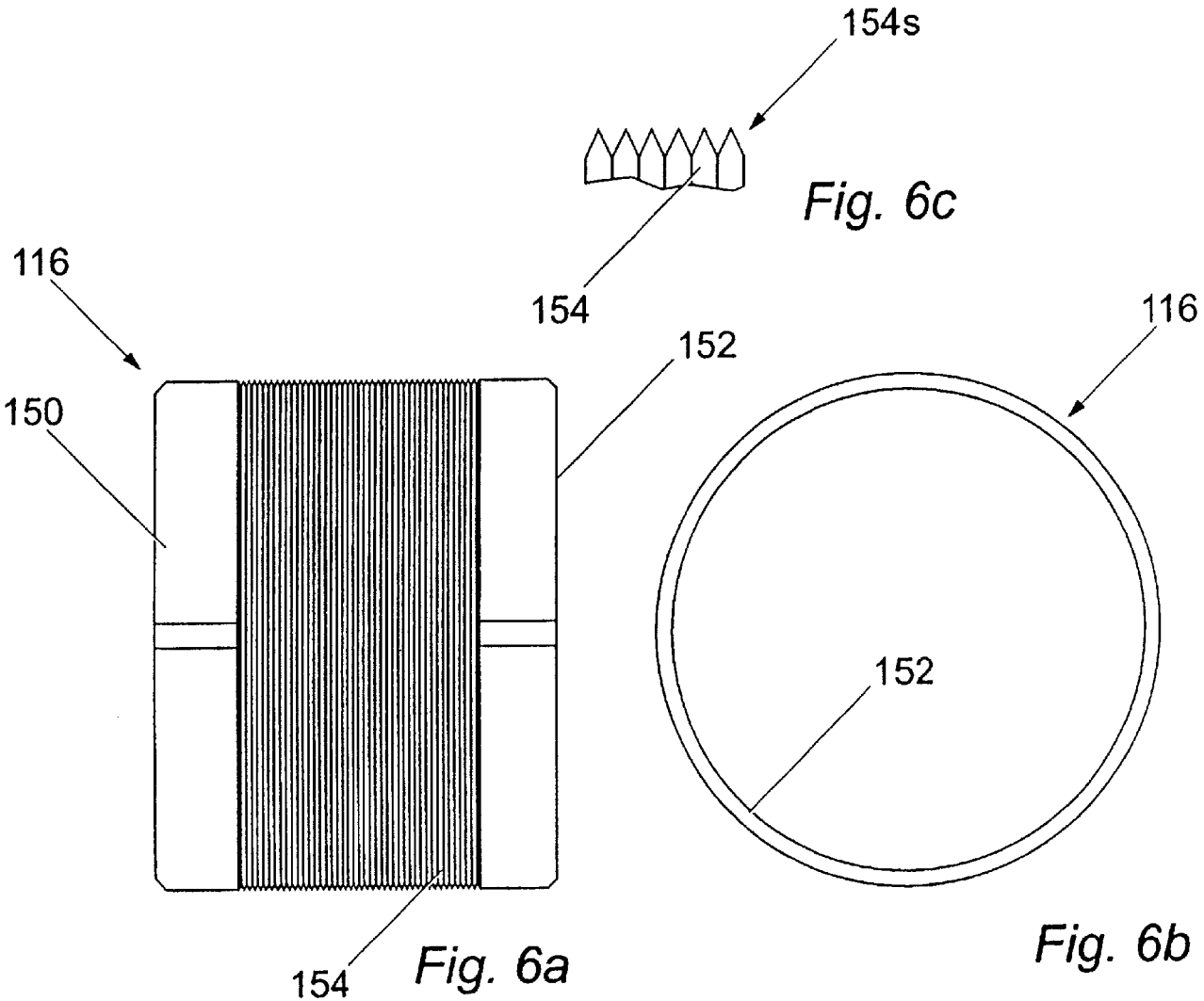
FIG. 6*a* is a front elevation showing a first configuration of a friction and/or sealing material that may be applied to an outer surface of the portions of casing shown in FIGS. 1 and 5.
FIG. 6*b* is an end elevation of the friction and/or sealing material of FIG. 6*a;*
FIG. 6*c* is an enlarged view of a portion of the material of FIGS. 6*a* and 6*b* showing a profiled outer surface.

For example, and referring to FIGS. 6*a* to 6*c*, the friction and/or sealing material 116 could comprise two outer bands 150, 152 of a first rubber, each band 150, 152 being in the order of 1 inch (approx. 25.4 mm) wide. A third band 154 of a second rubber is located between the two outer bands 150, 152, and is typically around 3 inches (76.2 mm) wide. The first rubber of the two outer bands 150, 152 is typically in the order of 90 durometers hardness, and the second rubber of the third band 154 is typically of 60 durometers hardness.

The two outer bands 150, 152 being of a harder rubber provide a relatively high temperature seal and a back-up seal to the relatively softer rubber of the third band 154. The third band 154 typically provides a lower temperature seal.

An outer face 154*s* of the third band 154 can be profiled as shown in FIG. 6*c*. The outer face 154*s* is ribbed to enhance the grip of the third band 154 on an inner face of a second conduit (e.g. a preinstalled portion of liner, casing or the like, or a wellbore formation) in which the casing portion 100 is located.

Figure 7B:
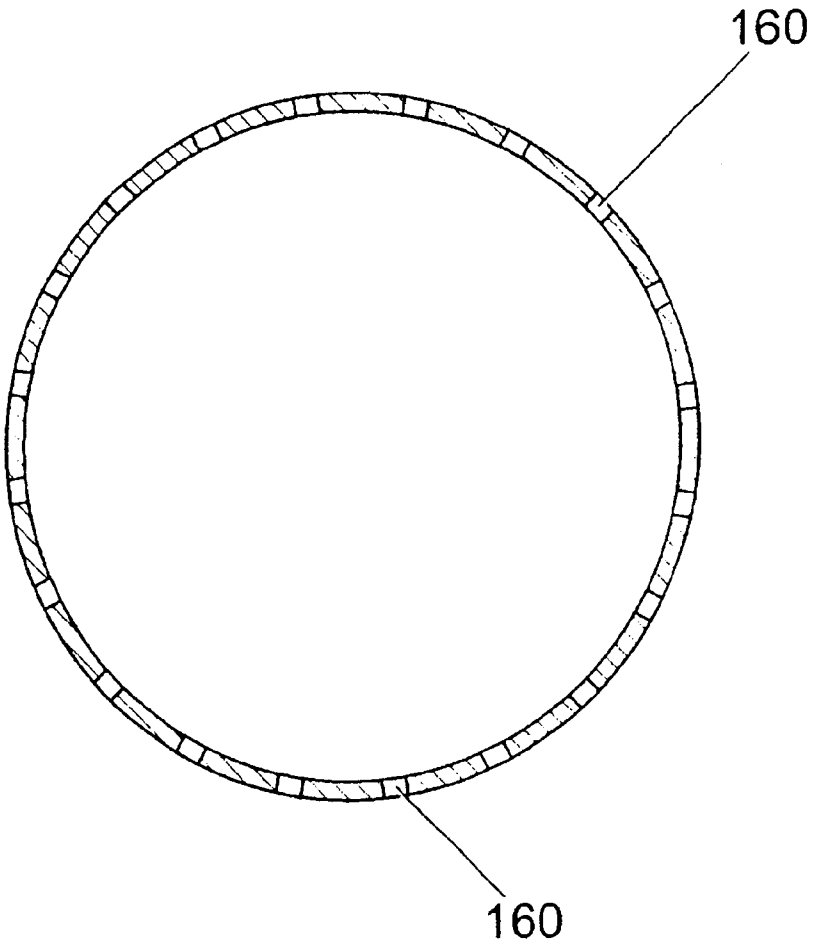
FIG. 7*b* is an end elevation of the material of FIG. 7*a*.
Figure 7A:
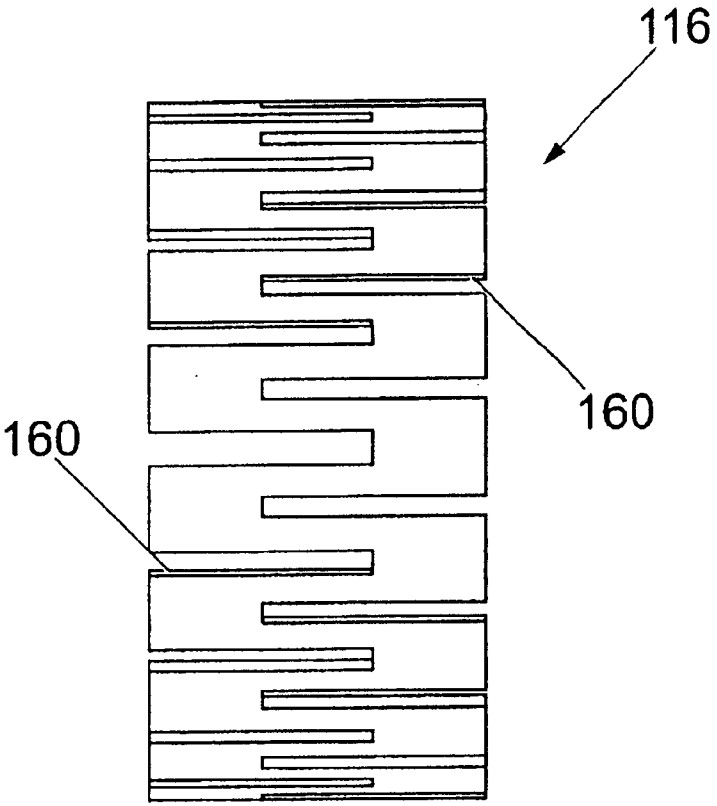
FIG. 7*a* is a front elevation of an alternative configuration of a friction and/or sealing material that can be applied to an outer surface of the casing portions of FIGS. 1 and 5.

As a further alternative, and referring to FIGS. 7*a* and 7*b*, the friction and/or sealing material 116 can be in the form of a zigzag. In this embodiment, the friction and/or sealing material 116 comprises a single (annular) band of rubber that is, for example, of 90 durometers hardness and is about 2.5 inches (approximately 28 mm) wide by around 0.12 inches (approximately 3 mm) deep.

To provide a zigzag pattern and hence increase the strength of the grip and/or seal that the material 116 provides in use, a number of slots 160 (e.g. 20) are milled into the band of rubber. The slots 160 are typically in the order of 0.2 inches (approximately 5 mm) wide by around 2 inches (approximately 50 mm) long. The slots 160 are milled at around 20 circumferentially spaced-apart locations, with around 18° between each along one edge of the band. The process is then repeated by milling another 20 slots 160 on the other side of the band, the slots on the other side being circumferentially offset by 9° from the slots 160 on the other side.

It should be noted that the casing portion 100 shown in FIG. 5 is commonly referred to as a pup joint that is in the region of 5–10 feet in length. However, the length of the casing portion 100 could be in the region of 30–45 feet, thus making the casing portion 100 a standard casing pipe length.

The embodiment of casing portion 100 shown in FIG. 5 has several advantages in that it can be expanded by a one-stage expander device (i.e. a device that is provided with one expanding shoulder), typically downhole. Thus, the casing portion 100 can be radially expanded by any conventional expander device. Additionally, casing portion 100 is easier and cheaper to manufacture than casing portion 10 (FIGS. 1 and 3).

Casing portion 100 may be used as a metal open hole packer. For example, a first casing portion 100 may be coupled to a string of expandable conduit, and a second casing portion 100 also coupled into the string, longitudinally (i.e. axially) spaced from the first casing portion 100. Thus, when the string of expandable conduit is expanded, the space between the first and second casing portions 100 will be isolated due to the friction and/or sealing material.

Thus, there is provided a casing portion that can be radially expanded with a reduced risk of loss of connection between the casing portions. In addition, the casing portion in certain embodiments is provided with at least one recess wherein a friction and/or sealing material (for example rubber) is housed within the recess whereby the material is substantially protected whilst the casing string is being run into the wellbore. Thereafter, the friction and/or sealing material becomes proud of the outer surface of the casing portion once the casing string has been expanded.

Additionally, there is provided an expander device that is particularly suited for use with the casing portion according to the first aspect of the present invention. The interspacing between the first and second annular shoulders in certain embodiments of the expander device is chosen to coincide with the interspacing between the annular shoulders and the at least one recess of the casing portion.

There is additionally provided an alternative casing portion that is provided with a protected portion in which a friction and/or sealing material can be located. The protected portion substantially protects the friction and/or sealing material that is applied to an outer surface of the casing whilst the casing is being run into a borehole or the like.

Modifications and improvements may be made to the foregoing without departing from the scope of the present invention.

What is claimed is:

1. A tubular member for a wellbore, the tubular member comprising coupling means to facilitate coupling of the tubular member into a string, the coupling means disposed on an annular shoulder of the tubular member provided at at least one end of the tubular member, wherein the tubular member at the annular shoulder has an inner diameter that is enlarged with respect to an inner diameter of the tubular member adjacent the annular shoulder.

2. A tubular member according to claim 1, further comprising at least one annular recess on an outer surface of the tubular member and a material located within the recess, the material selected from at least one member of the group consisting of friction materials and sealing materials.

3. A tubular member according to claim 1, wherein the coupling means comprises a first screw thread provided on an annular shoulder at a first end of the tubular member, and a second screw thread provided on an annular shoulder at a second end of the tubular member.

4. A tubular member according to claim 1, wherein the coupling means is disposed on an annular shoulder provided at each end of the tubular member.

5. A tubular member for a wellbore, the tubular member comprising coupling means to facilitate coupling of the tubular member into a string, the tubular member further including at least one recess wherein a material is located within the recess, the material selected from a group consisting of friction materials and sealing materials, and wherein the at least one recess is weakened to facilitate deformation of the at least one recess.

6. A tubular member according to claim 5 wherein an internal diameter of the at least one recess is reduced with respect to an internal diameter of the tubular member adjacent the recess.

7. A tubular member according to claim 6, wherein the internal diameter of the at least one recess is reduced by a multiple of a wall thickness of the tubular member.

8. An expander device comprising a body provided with a first annular shoulder, and a second annular shoulder spaced apart from the first annular shoulder, the second annular shoulder having an outer diameter greater than an outer diameter of the first annular shoulder, wherein the shoulders apply a radial force to an inside surface of an expandable tubular member.

9. An expander device according to claim 8, wherein the tubular member comprises coupling means to facilitate coupling of the tubular member into a string, the coupling means being disposed on an annular shoulder provided at at least one end of the tubular member, the tubular member further including at least one recess wherein a material is located within the recess, and wherein the material is selected from a group consisting of friction materials and sealing materials.

10. An expander device according to claim 9, wherein the second annular shoulder is spaced apart from the first annular shoulder by a distance substantially equal to the distance between an annular shoulder of a preceding tubular member and the at least one recess of the tubular member.

11. An expander device according to claim 9, wherein the first annular shoulder of the expander device contacts the at least one recess of the tubular member substantially simultaneously with the second annular shoulder of the expander device entering the annular shoulder of the tubular member.

12. A method of lining a borehole in an underground formation, comprising lowering a tubular member into the borehole, the tubular member including coupling means to facilitate coupling of the tubular member into a string, the coupling means disposed on an annular shoulder of the tubular member having an increased inner diameter and provided at at least one end of the tubular member, the tubular member further including at least one recess wherein a material is located within the recess, and applying a radial force to the tubular member using an expander device to induce a radial deformation of the tubular member, wherein the material is selected from a group consisting of friction materials and sealing materials.

13. A method according to claim 12, wherein the method includes the further step of removing the radial force from the tubular member.

14. A method of lining a borehole in an underground formation, comprising:

lowering a tubular member into the borehole, the tubular member comprising:

a first inner diameter along a body of the tubular member;

a second larger inner diameter that is larger than the first inner diameter and proximate a coupling of the tubular member; and at least one recess having a material located therein, the material selected from a group consisting of friction materials and sealing materials; and applying a radial force to the tubular member using an expander device to induce a radial deformation of the tubular member.

15. A method according to claim 14, wherein the tubular member at the recess has a third smaller inner diameter that is smaller than the first inner diameter.

16. A method according to claim 15, wherein a first annular shoulder of the expander device contacts the third smaller inner diameter of the tubular member substantially simultaneously with a second annular shoulder of the expander device entering the second larger inner diameter of the tubular member.

17. A method according to claim 15, wherein the applying a radial force to the tubular member expands at least the first inner diameter and the third smaller inner diameter of the tubular member.

18. A tubular member for a wellbore, comprising:

an expandable tubular body;

a coupling portion at one end of the tubular body, the coupling portion disposed on an annular shoulder of the tubular body, wherein the annular shoulder has an enlarged inner diameter with respect to an inner diameter of the tubular body adjacent the annular shoulder; and a material disposed on an outer surface of the tubular body, the material located on a protected portion so that the material is substantially protected while the tubular member is run into the wellbore, wherein the material is selected from at least one member of the group consisting of friction materials and sealing materials.

* * * * *